United States Patent [19]

Exler et al.

[11] 4,118,209

[45] Oct. 3, 1978

[54] CLIMATE-CONTROL UNIT PARTICULARLY FOR INCORPORATION IN A CONTAINER

[75] Inventors: Petrus André Theodorus Exler, Zoetermeer; Johannes Lobbe, Krimpen A/D IJssel, both of Netherlands

[73] Assignee: Pakhoed-Rotterdam B.V., Rotterdam, Netherlands

[21] Appl. No.: 706,603

[22] Filed: Jul. 19, 1976

[30] Foreign Application Priority Data

Jul. 18, 1975 [NL] Netherlands ..... 7508644

[51] Int. Cl.[2] ..... F25D 17/08

[52] U.S. Cl. ..... 62/176 D; 62/90; 165/16

[58] Field of Search ..... 165/16; 62/90, 176 D, 62/223, 176 R

[56] References Cited

U.S. PATENT DOCUMENTS

| | | | |
|---|---|---|---|
| 2,048,137 | 7/1936 | Palmer | 62/90 X |
| 2,107,268 | 2/1938 | Avery et al. | 165/16 |
| 2,112,344 | 3/1938 | Otto | 62/223 X |
| 2,257,478 | 9/1941 | Newton | 62/176 D X |
| 3,273,258 | 9/1966 | Liebert | 62/90 X |
| 3,585,811 | 6/1971 | Friedel | 62/90 X |
| 3,675,440 | 7/1972 | Ibrahim | 62/255 |
| 3,803,864 | 4/1974 | Cooper | 62/223 X |
| 3,916,644 | 11/1975 | Nasser | 62/90 X |
| 4,003,728 | 1/1977 | Rath | 62/176 R X |

*Primary Examiner*—William E. Wayner
*Assistant Examiner*—William E. Tapolcai, Jr.
*Attorney, Agent, or Firm*—John P. Snyder

[57] ABSTRACT

A climate-control unit which in regard of size and weight and of the required power, is particularly suitable for transporting goods in containers and the like, whilst it can provide optimum climate control even if the goods to be transported develop noxious gases.

The control-unit comprises a device for controlling the fresh air available in the container and/or to be introduced therein within previously adjustable temperature and humidity limits and by means for uniformly conveying air into the useful loading space and out of the same.

12 Claims, 9 Drawing Figures

CLIMATE-CONTROL UNIT PARTICULARLY FOR INCORPORATION IN A CONTAINER

Figure 1:
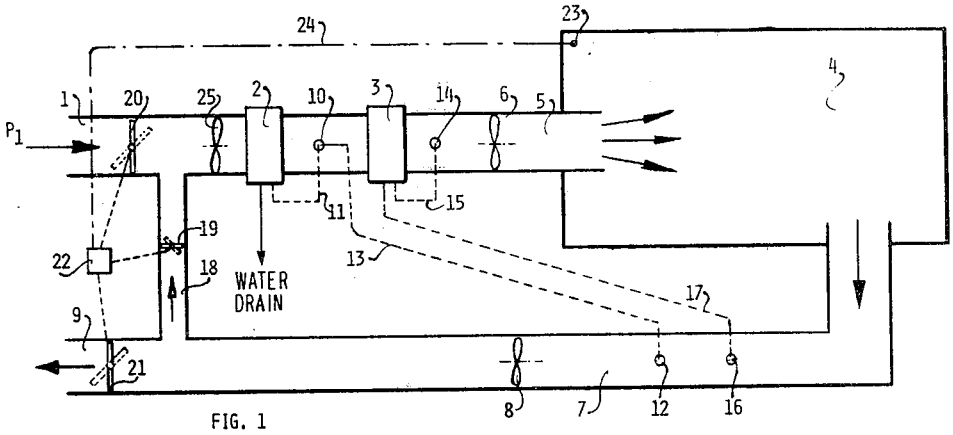

The invention relates to a climate control unit particularly for incorporation in a container for transporting perishable goods, for example, agricultural produce and other edible goods or for moisture-sensitive goods such as steel products, electronic apparatus and the like.

In general climate-control systems are known for use in buildings, dwellings or the like, but on account of their staticity, weight and size they are not suitable for use in loading spaces intended for transport. Particularly due to the lack of a permanent energy supply line, which is available for stationary systems, it is important to construct the control-unit so that minimum power is required because the control-unit has to be fed from an external energy from the transport means, for example, a train, a boat or a van or it has to be fed from an internal energy producer, for example, a Diesel generator, which must be comparatively small in view of the limited space available.

The invention now has for its object to provide a climate-control unit which in regard of size and weight and of the required power is particularly suitable for transporting goods in containers and the like, whilst it can provide optimum climate control even if the goods to be transported develop noxious gases.

The control-unit embodying the invention is characterized by a device for controlling the fresh air available in the container and/or to be introduced therein within previously adjustable temperature and humidity limits and by means for uniformly conveying air into the useful loading space and out of the same.

According to the invention the air-control device comprises a cooler for cooling down the air in the loading space below the desired temperature, means for conducting away precipitates of moisture from said air and a subsequent heater for raising the temperature of the air to the desired value, a thermostat being connected after said heater for controlling the heat supply to the air in the heater. With this arrangement moisture is extracted from the air, whilst the temperature of the air can be maintained within accurately determined limits.

In order to distribute the air uniformly in the useful loading space an inlet channel associated with a blower extends from the heater into the loading space, which is furthermore provided with an outlet channel associated with a blower for ensuring a uniform drainage.

According to the invention said outlet channel comprises a humidistat controlling the cooler and a thermostat controlling the heater. The humidistat preferably co-operates with a dew point thermostat connected downstream of the cooler but upstream of the heater and controlling, in addition, the cooler. Owing to this control-circuit it is possible to determine the condition of the air to be conducted away directly in the outlet channel and to feed it back to the cooler or the heater for controlling the air to be introduced. The dew point thermostat connected after the cooler determines the temperature at which moisture is precipitated from the air so that as the case may be, the thermostat can enhance cooling, in which case a greater quantity of moisture is withdrawn from the air.

According to the invention, in order to restrict the power required for cooling and subsequent heating it is advantageous to emply the condenser of a cooling aggregate of the compression-expansion type at least partly as a heater. Thus the condenser of the cooling aggregate a double function i.e., condensation of the coolant used in the cooler and heating of the air to be used in the loading space. Experiments have shown that in this way about 8 kW of electrical energy can be saved.

A further power saving is obtained by coupling the outlet channel through a return duct with the fresh-air inlet of the cooler. After the joint with the return duct the outlet channel, the return duct itself and the inlet channel in front of the joint with the return duct may be provided with a valve, which three valves may be controlled by a wet-bulb thermostat arranged in the useful loading space. By correct adjustment of the valves the condition of the air in the useful loading space can be rapidly set within the desired limits, whilst the fresh-air inlet is closed and partial recirculation and suction of fresh air can take place so that cooling and dehumidification may be reducted, whilst a full supply of fresh air and a full drainage of the air are possible, for example, in the event of large quantities of noxious gases produced by the load.

A special feature of the control-unit embodying the invention resides in that the capacity of the return duct is materially smaller than that of the inlet channel or the outlet channel, since recirculation does not require the maintenance of a large stream of air across the system. Owing to the limited capacity of the return duct the air stream is restricted without changing the speed of the required blowers. On the other hand the advantage of enormously large inlet and outlet of the required air is maintained as soon as the three valves in the ducts are differently adjusted.

The invention furthermore relates to a container or a loading space comprising the aforesaid control-unit.

In order to ensure optimum use of the control-device the container is provided with inlet and outlet channels arranged symmetrically viewed in cross-section and ensuring a uniform inlet and outlet respectively of the air. The wall of the container is insulated by a moisture-repelling insulating layer, preferably of a foam plastics.

According to an important aspect of the invention the inner wall is provided with ridges projecting out of the insulating layer, said ridges protecting the insulating layer against the contents and, in addition, ensuring a uniform recirculation of the air across the whole useful space of the container.

The ridges may be provided with air passages.

The channels concerned preferably have a self-supporting structure and are isolated from the useful loading space of the container.

Figure 2:
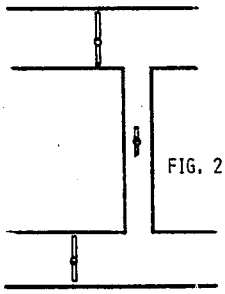
Figure 3:
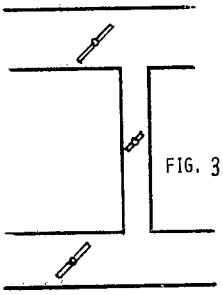
Figure 4:
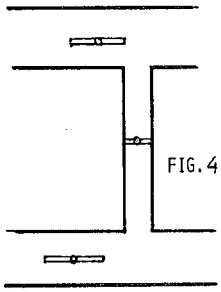
Figure 9:
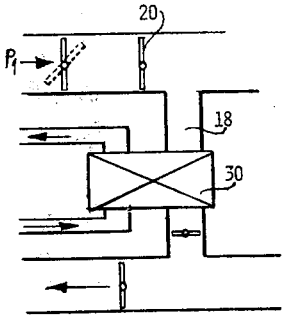
Figure 5:
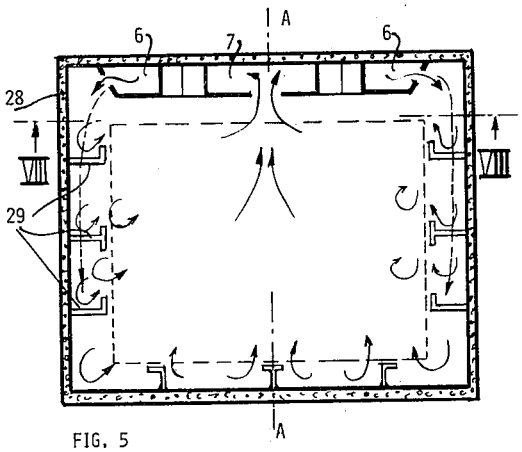
Figure 6:
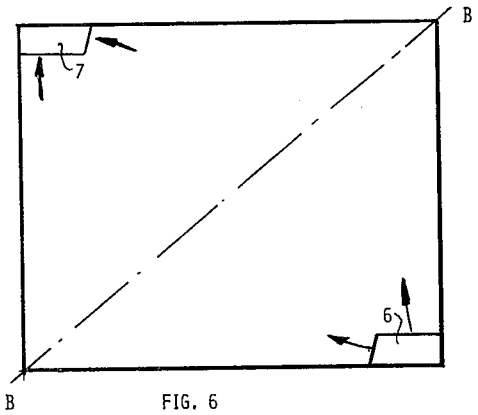
Figure 7:
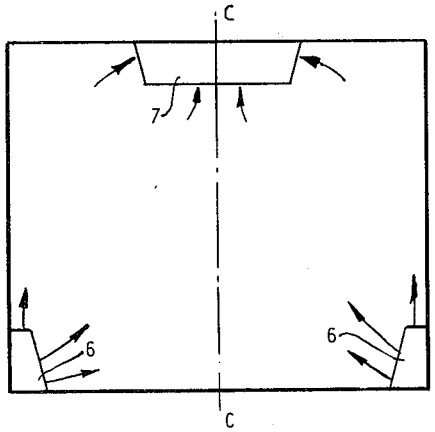
Figure 8:
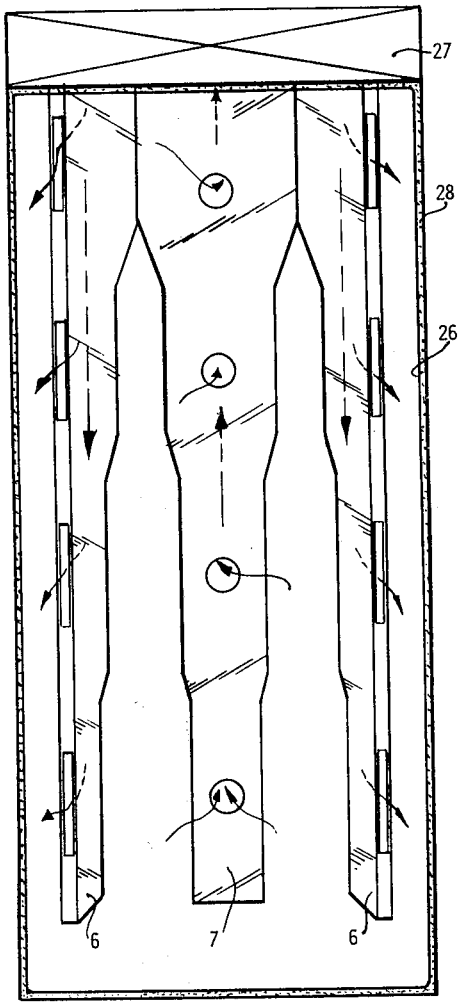

Other features and advantages of the invention will be apparent from the following description of an embodiment of the control-unit in accordance with the invention and of a few embodiments of container provided with inlet and outlet channels of the control-unit. In the drawing:

FIG. 1 is a diagram of the control-unit in accordance with the invention,

FIGS. 2, 3 and 4 illustrate different working positions of the valves included in the inlet, outlet and return ducts, FIGS. 5, 6 and 7 show corresponding cross-sectional views of containers comprising differently disposed inlet and outlet channels, FIG. 8 is a bottom view taken on the line XIII—XIII in FIG. 5 of the inlet and outlet channels, FIG. 9 is a control device as shown in FIG. 1, but extended by a humidity- and heat-exchange unit.

Referring to FIG. 1, reference numeral 1 designates the fresh-air inlet of the climate-control unit, the air stream being denoted by the arrow P1. The fresh-air inlet 1 opens out in a cooler 2, which may have any desired structure. The cooler 2 is joined by a heater 3, which may also be of any appropriate type. From the heater extends an inlet channel 5 associated with a blower 6 as far as into the useful loading space 4. From the useful loading space 4 an outlet channel 7 associated with a blower 8 extends to the outlet end 9. After the cooler 2 a thermostat 10 is provided for controlling the cooler, which is indicated by the broken line 11. The thermostat 10 co-operates with a humidistat 12 included in the outlet channel 7 and indicated by the broken line 13.

After the heater 3 a thermostat 14 is included in the inlet channel 5. This thermostat controls the heater 3 within accurately defined limits, which is schematically indicated by the broken line 15. The heater 3 is furthermore controlled by a thermostat 16 in the outlet channel 7, which is indicated by the broken line 17.

The outlet channel 7 is connected with the fresh-air inlet 1 through a return duct 18. The return duct 18 includes a valve 19 closing the passage of said duct and in front of the joint with the fresh-air inlet 1 a valve 20 closes said inlet and after the joint with the return duct 18 a valve 21 is included in the outlet 9. The valves can be set by suitable driving means in the closed, open or semi-open state. Said driving means, schematically represented by the block 22, are controlled by a thermostat 23 in the useful loading space 4, which is indicated by the broken line 24.

The control-unit for air conditioning the useful space 4 operates as follows.

The constantly rotating blowers 6 in the inlet channel 5 and 8 respectively in the outlet channel 7 provide a continuous stream of air across the system. The air is cooled in the cooler 2 to below the desired temperature, so that moisture is separated out of the air and conducted away by known means. The thermostat 10 is a dew point thermostat and is adjusted to the desired value for determining the temperature of the air, at which moisture is precipitated from the air. If the air appears to carry too much moisture, the cooler 2 is raised to a higher capacity so that more moisture is extracted from the air. Subsequently the air is heated in the heater 3 to the desired temperature, which is adjusted by the thermostat 14. The thermostat is of a type operating between very narrow limits.

After the air captured in the outlet channel 7 is spread in the useful loading space 4, the thermostat 16 determines the temperature and the humidistat 12 measures the humidity of the delivered air, which is returned to the heater 3 and the cooler 2 respectively. Subsequently the air is conducted away through the outlet 9.

By means of the valve system shown in FIGS. 2, 3 and 4 the air can be recycled through the return duct 18 or it can be reintroduced, partly conducted away or fully introduced and fully conducted away. In the position shown in FIG. 2 only recirculation is obtained, in which case the desired condition of the air in the loading space is rapidly attained. The thermostat 23 is adjusted to the desired wet-bulb temperature in the loading space. The wet-bulb temperature is a temperature at which the air can still absorb moisture.

FIG. 3 shows an intermediated position of the valves, in which recirculation is partly performed, fresh air is partly introduced and partly used air is conducted away. In this position, which is taken up after the initial phase, cooling and dehumidification can diminish. This depends, of course, also upon the conditions of the open air.

In the position shown in FIG. 4 recirculation takes place, but all used air is fully conducted away. This may be required if a cargo has to be transported, which develops such a quantity of noxious gases that all used air together with the noxious gases has to be immediately conducted away. It should be noted here that in accordance with the invention the capacity of the return duct may be materially lower than that of the inlet and outlet channel. With a constant speed of the blowers 6 and 8 it is ensured that solely by setting the valves 19, 20 and 21 only a small volume of stream is recirculated and fresh air is taken in a large volume. In the control-system shown in FIG. 1 a blower 25 may be added before the cooler, said blower slightly compressing the air to be introduced into the cooler. This rise in pressure prevents deposition of ice in the cooler.

FIGS. 5, 6, 7 and 8 show a container provided with inlet and outlet channels constructed in accordance with the invention for obtaining an optimum distribution of air in the useful loading space. The container is designated by 26. Part of the interior 27 serves for accommodating the cooler, the heater and, as the case may be, a Diesel generator for driving said cooler and heater respectively. From the part 27 inlet channels 6 and the outlet channel 7 extend into the useful loading space (see FIG. 8).

In order to obtain an optimum distribution of fresh air and used air the inlet and outlet channels, viewed in a cross-section, are arranged symmetrically in the container in accordance with the invention. The inlet and outlet channels 6 and 7 respectively of FIG. 5 are symmetrical to the line A—A, those of FIG. 6 are symmetrical to the line B—B and those of FIG. 7 are symmetrical to the line C—C.

The inner wall of the container is covered with an insulating layer 28, which may be applied to existing containers, for example, by spraying.

The inner wall is preferably also provided with ridges 29 extending in the direction of length of the container 26 for protecting the insulating layer 28 against the contents and for providing guide elements for the introduction of fresh air into the useful loading space. These ridges provide adequate turbulance so that the air distribution is improved. The ridges may have passages between a free buffer edge and the edge joining the sidewall.

Finally FIG. 9 shows an extension of the control-unit particularlt suitable for use in a cold ambient atmosphere. In the case of freezing cold the relative humidity and the temperature of the ambient air are low, which conditions may be utilized for conditioning air recirculated through the inlet in the cooler 2, when the air is recirculated through the return duct 18.

The return duct 18 is provided for this purpose with a moisture- and heat-exchanger shown in FIG. 9 as a combined enthalpy exchanger 30. If desired, the exchangers may be separated or either of both may be provided only.

As a matter of course, further variants of the control-unit may be developed within the scope of the invention. The container provided with such a control-unit may also be constructed in different forms.

What is claimed is:

1. A climate-control unit particularly for incorporation in a container for transporting perishable goods, for example, agricultural produce and other edible commodities or moisture-sensitive goods such as steel products, electronic apparatus and the like, comprising a device for controlling air contained in the loading space and/or fresh air to be introduced therein within predeterminable temperature and humidity limits, and means for uniformly conveying air in and out of the useful loading space; said means comprising a fresh air inlet, an air outlet, and a return duct communicating said inlet and said outlet, blower means in said inlet downstream of the connection of said return duct with said air inlet, and a valve in each said inlet, said outlet and said return duct; said valves being controlled by a wet-bulb thermostat to be mounted in the loading space.

2. A control-unit as claimed in claim 1 characterized in that the return duct includes a heat exchanger exchanger for transferring heat to the open air.

3. A control-unit as claimed in claim 2 characterized in that the moisture- and heat-exchangers are formed by an enthalpy exchanger.

4. A control-unit as claimed in claim 1 characterized in that the return duct includes a moisture exchanger for transferring moisture to the open air.

5. A control-unit as claimed in claim 4 characterized in that the moisture-and heat-exchangers are formed by an enthalpy exchanger.

6. A control-unit as claimed in claim 4 characterized in that the moisture- and heat-exchangers are formed by an enthalpy exchanger.

7. In a portable air conditioning system for the transportation of commodities, the combination of:

a load-receiving chamber having an air inlet system and an air outlet system, and a recirculation channel interconnecting said inlet and outlet systems;

a refrigerating system comprising a cooling portion disposed in said air inlet system and a heating portion also disposed in said air inlet system but disposed downstream of said cooling portion;

control means for separately controlling the cooling effect of said cooling portion and the heating effect of said heating portion whereby air discharged into said load-receiving chamber is at a controlled temperature greater than that immediately downstream of said cooler; and said control means including a humidistat in said outlet system controlling said cooling portion of the refrigerating system, a thermostat in said outlet system controlling said heating portion of the refrigeration system, and a thermostat in said inlet system, downstream of said heating portion, for controlling said heating portion of the refrigerating system.

8. In a portable air conditioning system for the transportation of commodities, the combination of:

a load-receiving chamber having an air inlet system and an air outlet system, and a recirculation channel interconnecting said inlet and outlet systems;

a refrigerating system comprising a cooling portion disposed in said air inlet system and a heating portion also disposed in said air inlet system but disposed downstream of said cooling portion;

control means for separately controlling the cooling effect of said cooling portion and the heating effect of said heating portion whereby air discharged into said load-receiving chamber is at a controlled temperature greater than that immediately downstream of said cooler; and a first valve in said air inlet system upstream of said recirculation channel, a second valve in said outlet system downstream of said recirculation channel, a third valve in said recirculation channel, and second control means for selectively operating said valves between one extreme in which said first and second valves are open while said third valve is closed and another extreme in which said first and second valves are closed while said third valve is open.

9. In a portable air conditioning system as defined in claim 8 wherein said second control means comprises a thermostat in said load-receiving chamber.

10. In a portable air conditioning system as defined in claim 9 wherein said control means includes a humidistat in said outlet system controlling said cooling portion of the refrigerating system.

11. In a portable air conditioning system, as defined in claim 10 wherein said control means includes a thermostat in said outlet system controlling said heating portion of the refrigeration system.

12. In a portable air conditioning system, as defined in claim 11 wherein said control means includes a thermostat in said inlet system, downstream of said heating portion, for controlling said heating portion of the refrigerating system.

* * * * *